United States Patent [19]

Grover

[11] Patent Number: 4,481,719

[45] Date of Patent: Nov. 13, 1984

[54] DRAFTING APPARATUS

[76] Inventor: Roger Grover, 1605 Treanor St., Saginaw, Mich. 48601

[21] Appl. No.: 455,428

[22] Filed: Jan. 3, 1983

[51] Int. Cl.[3] ..... B43L 13/02

[52] U.S. Cl. ..... 33/437; 33/125 C

[58] Field of Search ..... 33/1 M, 125 C, 433, 33/437, 446, 479

[56] References Cited

U.S. PATENT DOCUMENTS

| | | | |
|---|---|---|---|
| 2,190,947 | 2/1940 | Kinzler | 33/437 |
| 3,311,982 | 4/1967 | Dalrymple | 33/437 |
| 3,525,156 | 8/1970 | Witt | 33/437 |
| 3,537,183 | 11/1970 | Anderson | 33/437 |
| 4,237,617 | 12/1980 | Goussios | 33/1 M |

FOREIGN PATENT DOCUMENTS

| | | | |
|---|---|---|---|
| 61711 | 5/1955 | France | 33/437 |
| 1247612 | 10/1960 | France | 33/437 |
| 81613 | 4/1953 | Norway | 33/437 |
| 361919 | 11/1931 | United Kingdom | 33/437 |

*Primary Examiner*—Richard R. Stearns
*Attorney, Agent, or Firm*—John J. Swartz

[57] ABSTRACT

A drafting table and measurement system which utilizes a read head for measuring the displacement of a straight edge overlying the drafting table. The drafting table mounts two perpendicularly disposed straight edges, one of which moves to and fro along the X-axis of the drafting table and the other which moves in a to-and-fro movement along the Y-axis of the table. Each straight edge is mounted on a carrier block via an adjustable member which can be operated to draw a portion of the straight edge toward the carrier block to clamp the straight edge to the table and inhibit the to-and-fro movement. A read head is mounted on each carrier block in justaposition with a scale that slidably receives the carrier block. The read head cooperates with the scale to provide a signal representative of the displacement of the straight edge.

1 Claim, 4 Drawing Figures

DRAFTING APPARATUS

BACKGROUND OF THE INVENTION

1. Field of the Invention

This invention relates to drafting apparatus and, more particularly, to new and novel apparatus for precisely measuring the coordinates of a drawing surface and the location and displacement of a drafting straight edge.

2. Description of the Prior Art

The operation of various machines, such as milling machines, is frequently controlled via computerized machine control systems. The computer programs are defined by X, Y and Z coordinates. The programs which are written for such machines typically start out at an absolute zero point, commonly referred to as ABS.

Heretofore, it has been conventional for a draftsman to construct a drawing of a part to be machined, slavishly calculate incremental movements from point to point about the drawing, and then relate the individual incremental movements to the absolute zero point.

Electronic drafting instruments have been provided heretofore, such as that disclosed in U.S. Pat. No. 4,282,571 issued to Joseph Giovannoli et al on Aug. 4, 1981, which discloses a photo-sensitive device utilized in combination with a microprocessor to continually display the numerical equivalent of a cursor's position on a drafting board. In one arrangement disclosed in the Giovannoli, et al patent, relative positions of a movable cursor selector can be used to determine the length of a line segment by storing the first measured value and subtracting the second measured value. A photo-sensitive device is mounted in such a way that it may slide along an array of cursor segments which are positioned under a movable cursor selector, and in such a way that the lighted cursor segment illuminates a photo-sensitive device.

U.S. Pat. No. 4,184,261, granted to Wolfgang P. Buerner on Jan. 22, 1980, discloses a multi-purpose drafting instrument which utilizes a signal generator in combination with a display unit for measuring and optically displaying the X and Y coordinate values of any selected point within an X-Y quadrant. U.S. Pat. No. 4,246,703, granted to McLouis Robinet on Jan. 27, 1981, as well as U.S. Pat. No. 4,244,105, granted to Constantine Goussios on Jan. 13, 1981, further disclose drafting devices which utilize electronic measuring devices and optical display readouts in combination therewith for measuring displacement of a drafting instrument.

Various devices have been provided for mounting conventional drafting T-squares or drafting straight edges, such as U.S. Pat. No. 694,389 granted to A. Klitsche on Mar. 4, 1902; U.S. Pat. No. 3,864,833 granted to Harold Bokelman on Feb. 11, 1975; U.S. Pat. No. 3,537,183 granted to R. J. Anderson on Nov. 3, 1970; U.S. Pat. No. 1,115,333 granted to H.O. Pease on Oct. 27, 1914; and U.S. Pat. No. 329,392 granted to E. Jordan on Oct. 27, 1885. None of the prior art discloses the concept of combining a slide carrier for a drafting straight edge with a reader head for determing precise measurements and locations of a drafting instrument on a drafting surface. Accordingly, it is an object of the present invention to provide a new and novel drafting straight edge mounting slide carrier which mounts a reader head for determining precise measurements on a drafting board.

It is yet another object of the present invention to provide a new and novel drafting instrument having a drafting straight edge mounting slide which mounts a reader head thereon for measuring coordinates on a mechanical drawing surface.

A further object of the present invention is to provide drafting apparatus including a pair of perpendicularly disposed elongate drafting straight edges and a new and novel mechanism for mounting the straight edges and reader heads for reciprocal to-and-fro movement.

Another object of the present invention is to provide drafting apparatus of the type described, including a carrier block for an elongate drafting straight edge which also mounts a reader head for measuring the location and displacement of the straight edge.

Yet another object of the present invention is to provide new and novel electronic drafting apparatus which will expedite the programming of a computerized machine control for a machine tool.

Still another object of the present invention is to provide new and novel drafting apparatus which comprises a measurement system including a non-contact, photo-optical reader head mounted on a reciprocal slide carrier block which mounts an elongate drafting straight edge.

It is yet another object of the present invention to provide drafting apparatus including a pair of perpendicularly arranged elongate drafting members which overly a drafting table, and mechanism for reciprocally mounting the straight edge members for to-and-fro movement, and mechanism coupling the straight edge members to carrier blocks for selectively clamping the straight edge members to the drafting table to selectively inhibit the to-and-fro movement.

It is another object of the present invention to provide a drafting system which will assist the user to draw any geometric plane, of a part to be machined, showing where and how the part is clamped, the size and type of cutter, the ABS starting point, the central line of tooling path, and any other helpful information that will speed programming and the set-up of equipment.

It is another object of the present invention to provide new and novel drafting apparatus which will assist a draftsman to draw an arc tangent to any side or angle and then plot the center line of the arc for location of the centerline of a machining tool, without the use of calculators and trigonometric functions.

Other objects and advantages of the present invention will become apparent to those of ordinary skill in the art as the description thereof proceeds.

SUMMARY OF THE INVENTION

Drafting apparatus for measuring any selected one of a plurality of various different coordinates of a mechanical drawing surface on a drawing table, comprising first and second normally disposed straight edge members for overlying said table; first and second slides mounting the first and second straight edge members respectively, for sliding movement on said table in to-and-fro perpendicularly disposed paths of travel; mechanism coupling said first and second straight edge members to said first and second slides, respectively, including mechanism for selectively clamping said first and second straight edge members to the table to selectively inhibit said to-and-fro movement; and a measurement system comprising read head mechanism mounted on each of the slides for measuring the displacement of the elongate straight edge members, including transducer mechanism for providing an electrical output signal representative of the displacement.

BRIEF DESCRIPTION OF THE DRAWINGS

The invention may be more readily understood by reference to the accompanying drawings, in which.

DESCRIPTION OF THE PREFERRED EMBODIMENT

Figure 1:
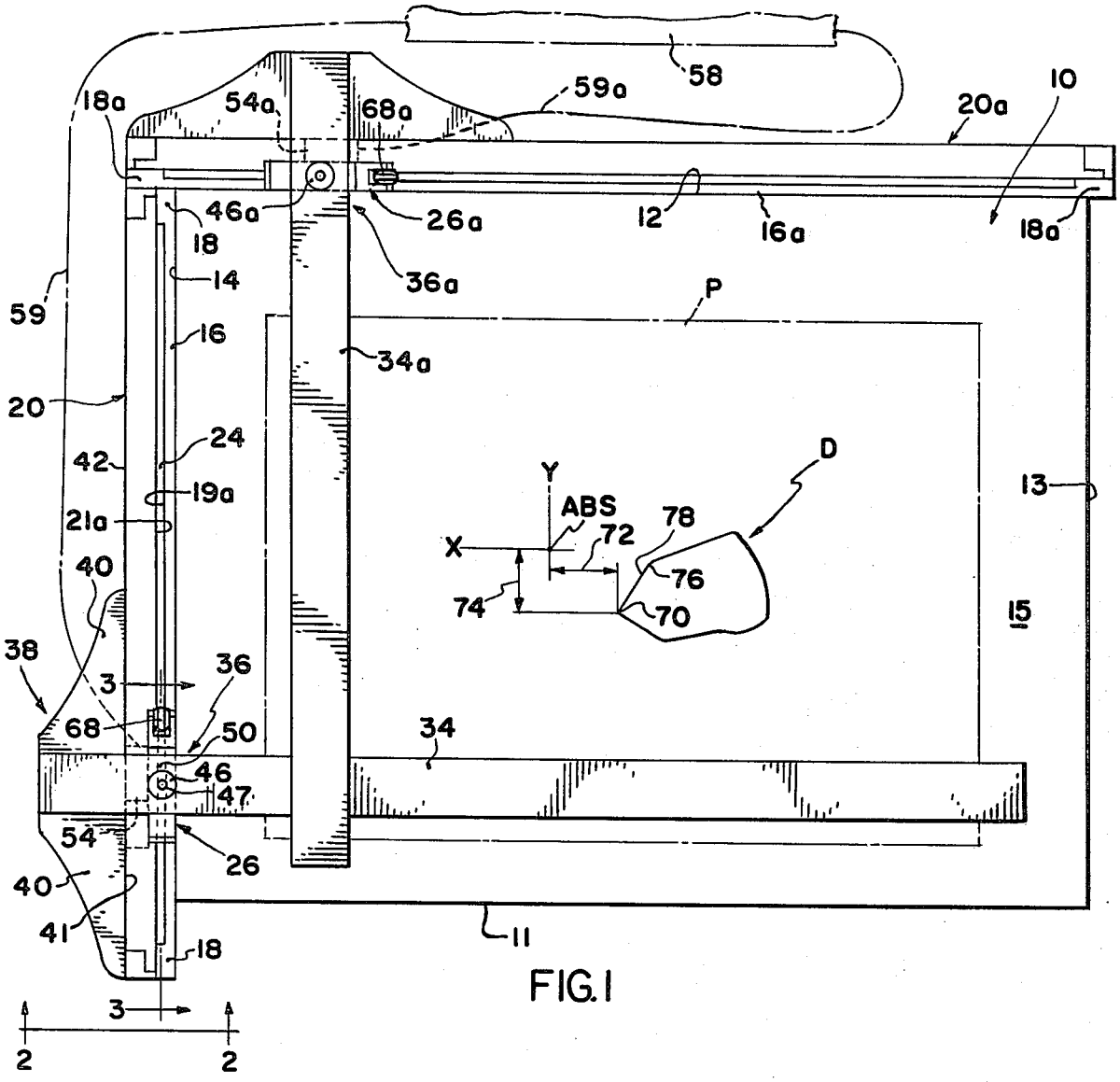
FIG. 1 is a top plan view of drafting apparatus constructed according to the present invention.
Figure 2:
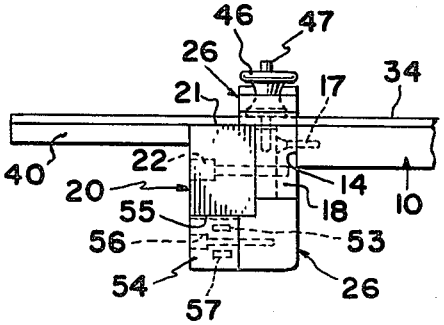
FIG. 2 is an enlarged fragmentary side view, taken along the line 2—2 of FIG. 1.
Figure 3:
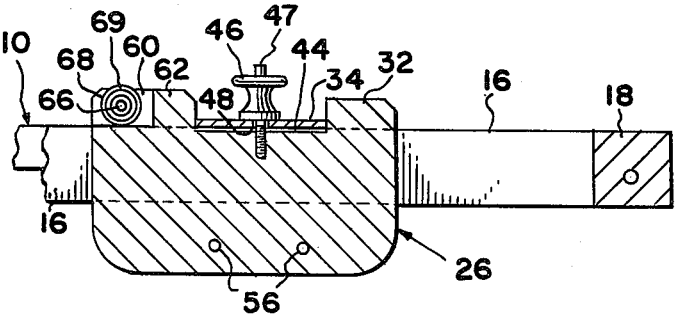
FIG. 3 is a sectional end view, taken along the line 3—3 of FIG. 1.
Figure 4:
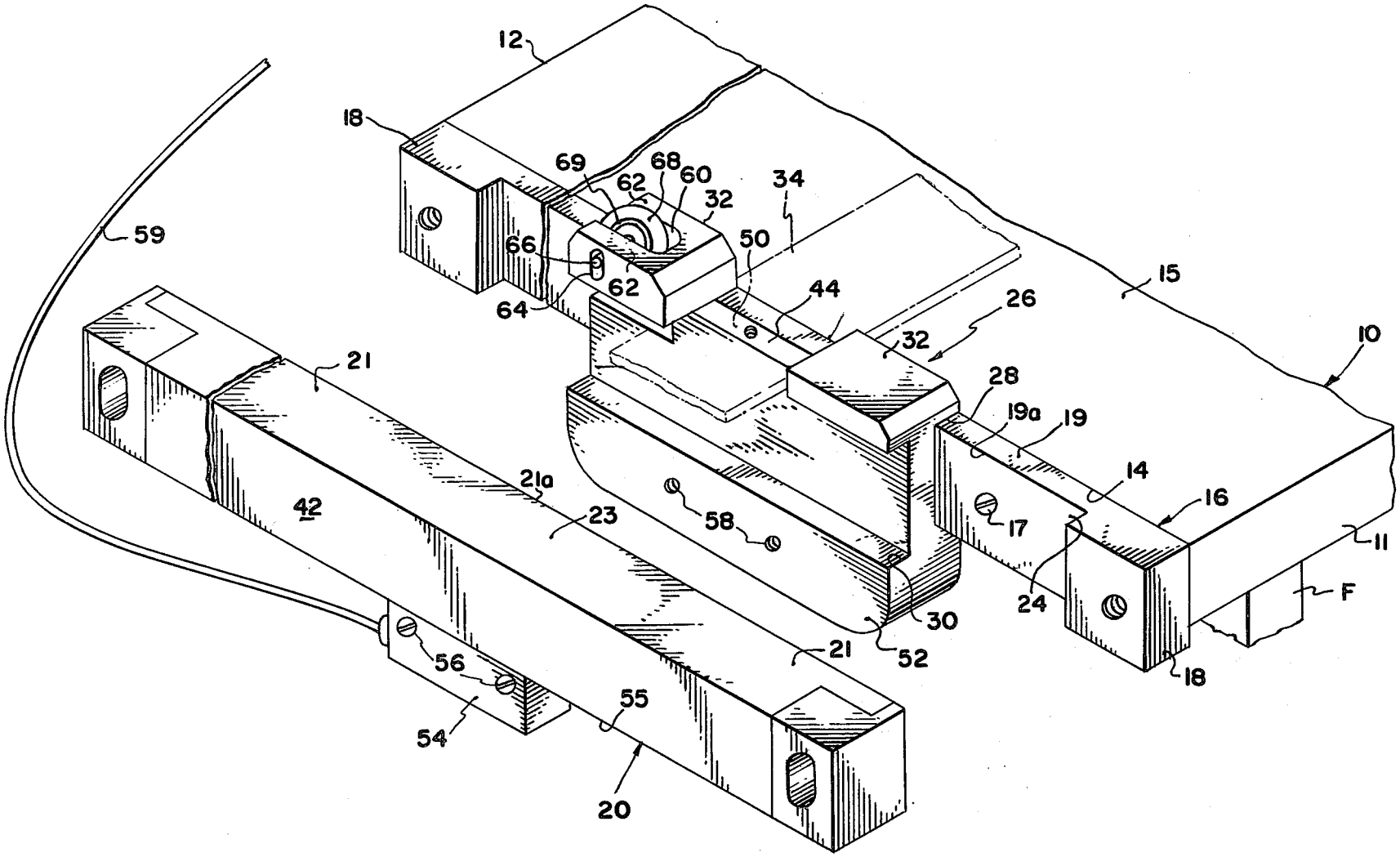
FIG. 4 is an enlarged, perspective view, more particularly illustrating one end of the drafting apparatus illustrated in FIGS. 1-3.

Apparatus constructed according to the present invention is particularly adapted for a drafting table or drawing board, generally designated 10, mounted on a frame, generally designated F. The table 10 includes a top planer drafting surface 15 having front and rear parallel edges 11 and 12 spanned by parallel side edges 13 and 14. A sheet of drafting paper P having a drawing D of a typical part is illustrated in position on the planer drafting surface 15.

Mounted on the lateral edge 14, via suitable screws 17, is an elongate guide 16. Opposite ends of the guide 16 are provided with laterally outwardly projecting mounting ears 18 which mount, via suitable threaded bolts 22, a chrome-etched parallely disposed glass scale 20. The midportion 23 of the glass scale 20 is thus spaced from the elongate guide 16 via an elongate slot 24 which slidably receives a T-square mounting carrier block, generally designated 26. As illustrated, the upper surfaces 19 and 21 of guide 16 and scale 20 are flush with the planer surface 15.

The carrier block 26 includes a laterally inwardly opening, lateral slot 28 which slidably receives the guide 16 and a laterally opposite, laterally outwardly opening slot 30 which slidably receives the glass scale 20.

A T-square, generally designated 36, is provided and includes an elongate straight edge member 34 fixed to a mounting head 38. The carrier block 26 includes a pair of upstanding, spaced-apart T-square mounting projections or flanges 32 which snugly receive opposite sides of the elongate straight edge member 34. The T-square mounting head 38 includes oppositely projecting, perpendicularly disposed guide portions 40 having laterally inner, linear surfaces 41 which slidably bear against the outer planer surface 42 of the glass scale 20.

The T-square carrier block 26 includes an upper surface portion 44, interjacent the mounting projections 32, which is disposed at a level below the level of planar drafting surface 15. The upper surface portion 44 and upwardly extending projections 32 thus form a transverse slot which receives the straight edge member 34. The T-square straight edge member 34 is coupled to the carrier block 26 via a threaded lock nut, generally designated 46, which is threadedly received on an upstanding threaded bolt 47 that is fixed to carrier block 26. The bolt 47 is freely received in an aperture 48 provided in portion 50 of straight edge member 34. When the lock nut 46 is unturned, the carrier block 26 and T-square 36 are free to slide along the lateral drafting board edge 14 in a to-and-fro path; however, when the lock nut is "turned down" on bolt 47, the straight edge portion 50 will be drawn downwardly toward the surface 44 but will remain in spaced relation thereto, so that the elongate straight edge member 34 is clamped to the drafting surface 15 to inhibit sliding movement of the carrier block 26 and T-square 36 relative to the drafting table 10.

Mounted on the lower portion 52 of the carrier block 26 is a non-contact, photo-optical reader head 54 via suitable screws 56 threadedly received in apertures 58. The reader head 54 includes a source of illumination 53 which is directed toward the lower surface 55 of scale 20 which may have a series of alternating reflective and non-reflective marks. Also mounted on reader head 54 is a photo-detector 57 which is positioned to receive light from the light source 53 only when the light is redirected by one of the reflective marks. Accordingly, the photodetector 57 (which may be a photo-resistive, photodiode, phototransistor or other type of photosensitive device capable of altering its electrical properties in response to a light signal) will produce an altered electrical output as the reader head is moved along the series of alternating reflective and non-reflective marks. The resolution of this system may be enhanced by increasing the number of marks per unit length of the scale 20. It would also be possible to employ a transmissive type non-contact reader head where the light source is placed on one side of an optical scale and the photodetector is placed on the opposite side. In this situation, the scale would be provided with a series of optically transmissive and nontransmissive marks for modulating the output of the photodetector as the reader head is moved along the scale. The reader heads 54 may suitably comprise a transducer of the type sold under the trademark "Anilam" by Anilam Electronics Corporation, 5625 N.W. 79th Avenue, Miami, Fla., Model No. MBT, MJB or SST. The transducers or reader heads 54 cooperate with the glass scale 20 to provide an output signal via wires 59 to a digital optical display unit, generally designated 58, which may suitably comprise a console of the type sold by Anilam Electronics Corporation under the trademark "Mini-Wizard", Model 102-2.

The reader head 54 supplies electrical signals to the digital optical display unit 58 which optically displays the exact location and measurement of the coordinate values along the Y axis, as well as displacement of the elongate straight edge member 34 along the Y axis.

One of the carrier block mounting projections 32 is slotted, as at 60, to provide a pair of parallel ears 62 which receive a knurled thumb-wheel 68 fixed to a shaft 66 which is received in vertical slots 64 provided in mounting ears 62. The thumb-wheel 68 includes axially spaced chamfered peripheral edges 69 which normally rollingly engage the confronting inner edges **19*a* and 21*a* of upper surfaces 19 and 21 respectively so as not to interfere with sliding movement of carrier block 26; however, downward pressure on the thumb-wheel 68 will force chamfered surfaces 69 to pinch between the edges 19*a* and 21*a* so that when the thumb-wheel 68 is manually rotated about its axis, the wheel 68 will incrementally adjust the position of the carrier block 26 and the T-square 36**.

The rear edge 12 of the drafting board 10 mounts apparatus generally identical to the apparatus mounted on the edge 14, and generally similar parts will be identified by generally similar reference characters, followed by the letter a. The T-square member **36*a*** is utilized in drafting vertical lines and moves along the X axis of the drafting surface.

THE OPERATION

Assuming that the draftsman wants to formulate a computer program for operating a milling machine which would mill a part, illustrated by the drawing D, the draftsman would initially move the straight edges 34 and 34*a* until they intersect the absolute zero point, ABS. The read heads 54 and 54*a* will provide a signal to display unit 50 which will optically display the X and Y coordinates values of the ABS point. The ABS coordinates are recorded as the initial step of the program. The draftsman would then move the T-square elongate members 34 and 34*a* until they intersect the starting point 70 which, for example, might be five inches to the right and three inches below the absolute zero point ABS on the X-Y axis, these measurements being represented by the reference characters 72 and 74. The draftsman would "turn down" lock nuts 46 to fix the T-squares to the drafting board. The read heads 54 and 54*a* will provide electrical signals to the display unit 50 representative of the displacement 72 and 74 and the X - Y coordinates of starting point 70. The display unit will optically display the displacement and location of point 70. The draftsman then records this data as the next step of the program. The program might also include an instruction for rapid advance from the absolute zero point ABS to the starting point 70.

The draftsman would then release the lock nuts 46 and move the T-square straight edge members 34 and 38 until they intersect the next "point" 76 on the drawing D, and this, for example, might be located at an angle of 45 degrees relative to the horizontal and at a distance represented by the reference character 78 of two inches from point 70. Rather than having to slavishly calculate the movement from point 70 to point 76 relative to the movement from the absolute zero point ABS, the digital display apparatus 58 can be reset after each successive point is reached so that the draftsman not only knows the distance 78 from point 70 to 76 but also knows the distances relative to the absolute zero point ABS. Accordingly, the apparatus constructed according to the present invention results in a saving of countless hours and calculations in preparing the program.

The draftsman will continue about the part until he returns to the starting point. The draftsman can then easily add the Z coordinates if necessary.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Drafting apparatus for measuring any selected one of a plurality of various different coordinates of a mechanical drawing surface on a drafting table, said apparatus comprising:

first and second normally disposed straight edge means for overlying said table;

first and second slide means mounting said first and second straight edge means respectively, for sliding movement on said table in to-and-fro perpendicularly disposed paths of travel;

means coupling said first and second straight edge means to said first and second slide means, respectively, including:

means for selectively clamping said first and second straight edge means to said table to selectively inhibit said to-and-fro movement; and a measurement system comprising:

read head means mounted on each of said slide means for measuring the displacement of said elongate straight edge means including transducer means for providing electrical output signal means representative of said displacement;

a glass scale; and means for mounting said glass scale on said drafting board so as to define a slot for receiving a portion of said slide means;

said read head means being juxtaposed with said glass scale and cooperating therewith to provide an electrical output signal representative of the position of said straight edge means.

* * * * *